US005328323A

United States Patent [19]

Molison

[11] Patent Number: 5,328,323

[45] Date of Patent: Jul. 12, 1994

[54] STACK MAKING MACHINE

[75] Inventor: Robert E. Molison, Hanover, Pa.

[73] Assignee: Elsner Engineering Works, Inc., Hanover, Pa.

[21] Appl. No.: 965,962

[22] Filed: Nov. 3, 1992

[51] Int. Cl.[5] ..... B65H 31/30

[52] U.S. Cl. ..... 414/790.4; 414/790.9; 414/791.1

[58] Field of Search ..... 414/790, 790.4, 790.9, 414/791.1, 793.4, 793.8, 794.2

[56] References Cited

U.S. PATENT DOCUMENTS

| | | | |
|---|---|---|---|
| 3,374,902 | 3/1968 | Mills . | |
| 3,420,386 | 1/1969 | Morrow et al. . | |
| 3,498,600 | 3/1970 | Spencer et al. . | |
| 3,599,805 | 8/1971 | Spencer . | |
| 3,643,816 | 2/1972 | Jacobsen | 414/790.4 |
| 4,285,621 | 8/1981 | Spencer . | |
| 4,457,656 | 7/1984 | Kosina et al. . | |
| 4,615,521 | 10/1986 | Mori | 414/790 |
| 4,938,657 | 7/1990 | Benson et al. . | |

FOREIGN PATENT DOCUMENTS

| | | | |
|---|---|---|---|
| 1456547 | 2/1969 | Fed. Rep. of Germany | 414/790.4 |
| 2209561 | 9/1972 | Fed. Rep. of Germany | 414/793.4 |
| 1013 | 2/1963 | Japan | 414/790.4 |

*Primary Examiner*—Michael S. Huppert
*Assistant Examiner*—Gregory A. Morse
*Attorney, Agent, or Firm*—Thomas Hooker

[57] ABSTRACT

A stack making machine includes an infeed conveyor for moving successive web segments to an orbital stacker which pushes the segments down from the infeed conveyor and onto one of two pairs of stack support members located to either side of the infeed conveyor. Drives lower the stack support members and place stacks built up on the stack support members on a discharge conveyor. The drives move the stack support members around like paths extending down from a first position under one side of the infeed conveyor beneath the stacker to the discharge conveyor, out away from the discharge conveyor and then back up to the first position. The stacking area is visually and manually accessible.

16 Claims, 8 Drawing Sheets 18
5
88
86
30
76
90
112
22
26
126
112'
92
24
98
126'
32
28
160
94
144
152'
144'
142
142'
140
140'
152
160'
134
134'
162
108
106
102
110
164
100
84
82
5

STACK MAKING MACHINE

FIELD OF THE INVENTION

The invention relates to machines for receiving successive web segments, placing the segments in a plurality of stacks and conveying the stacks away from the machine.

DESCRIPTION OF THE PRIOR ART

Conventional stacking machines receive web segments, arrange the segments in stacks and convey the stacks away from the machine. These machines, however use complicated stackers which frequently obscure the stacking area from observation and prevent ready access to the stacking area for confirming proper operation of the machine, making adjustments of the machine in the stacking area and, if necessary, removing jams.

SUMMARY OF THE INVENTION

The invention is an improved reliable high speed stacking machine capable of receiving up to 600 web segments per minute at a web speed of about 400 feet (122 meters) per minute and placing the segments into stacks and conveying the stacks away from the machine. The machine is particularly useful in receiving and stacking liquid-saturated web segments, typically formed from Z-folded fabric to form wipes. The wipes are saturated with a liquid appropriate for the intended application of the wipe.

The machine is easily adjustable to accommodate segments having different cut lengths and widths and to vary the number of segments in a completed stack. The stacking area is visually and manually accessible in order to permit visual confirmation of proper operation of the machine and, when necessary, to make adjustments of the machine components at the stacking station.

Other objects and features of the invention will become apparent as the description proceeds, especially when taken in conjunction with the accompanying drawings illustrating the invention, of which there are eight sheets and one embodiment.

DESCRIPTION OF THE PREFERRED EMBODIMENT

Figure 1:
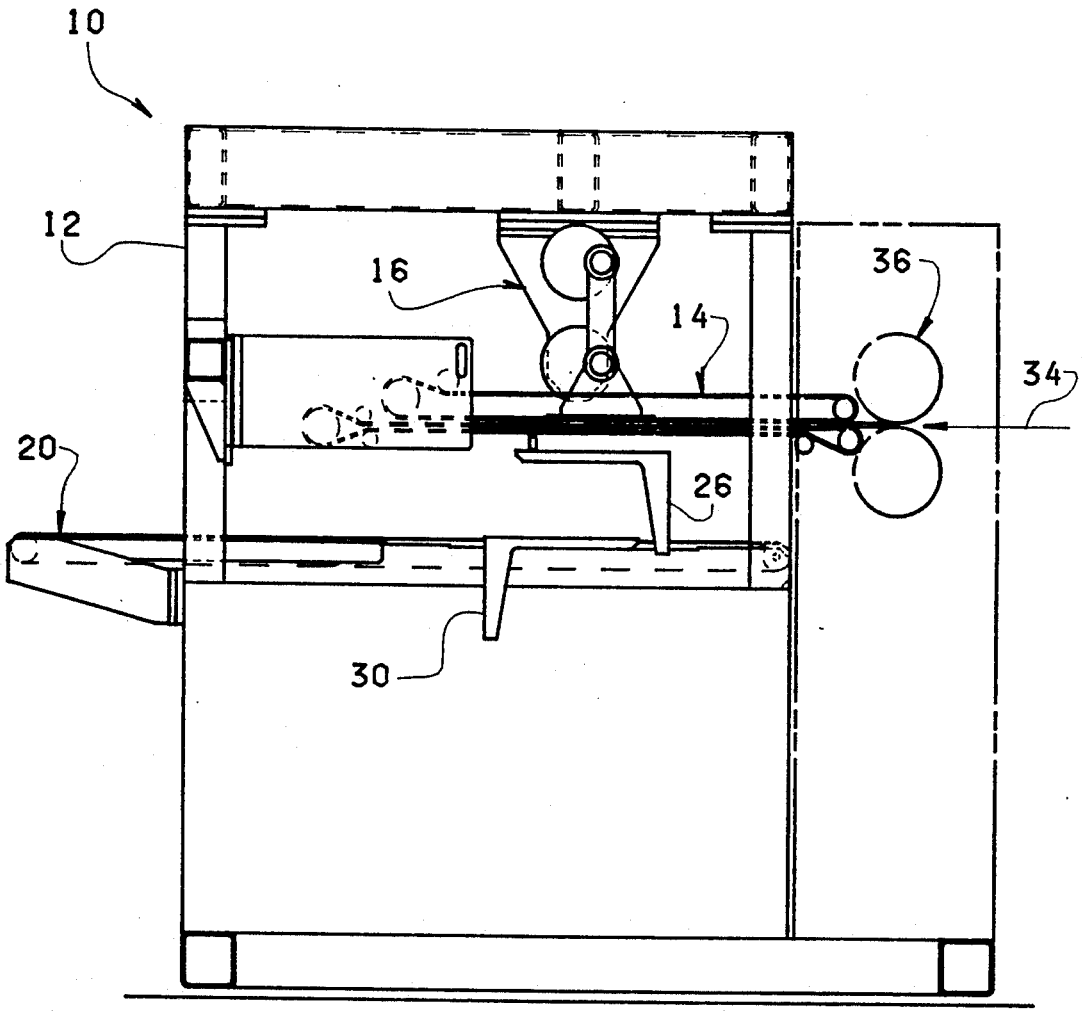
FIG. 1 is a side view of a stack making machine according to the invention.

Stack making machine 10 shown generally in FIG. 1 includes a frame 12, a sheet infeed conveyor 14, an orbital sheet stacker or pusher 16 located above the infeed conveyor, a stack support assembly 18 shown in detail in FIGS. 4 and 5*a*, 5*b* and 5*c* and a stack discharge conveyor 20 located below the infeed conveyor. The stack support assembly 18 includes a pair of like stack support units 22 and 24 for supporting alternate stacks formed from web segments received from conveyor 14. Stack support unit 22 includes a pair of stack support arms 26 and an arm drive 28 for repetitively moving the arms through the cycle illustrated in FIG. 7. Stack support unit 24 includes a pair of stack support arms 30, like arms 26, and an arm drive 32, like drive 28, for moving the arms 30 repetitively through the same cycle as shown in FIG. 7 but 180 degrees out of phase with the cycle of unit 22.

A continuous web, which may include Z-folded layers of a non-woven fabric saturated with a liquid, is fed to the machine 10 in the direction of arrow 34 and passes through a two-roll web cutter 36. The cutter severs the web into individual web segments 38 which are moved along the sheet infeed conveyor 14 to the stacker 16. The stacker 16 pushes each sheet segment below the conveyor 14. The segment falls onto one of the two pairs of stack support arms 26 or 30. The arms are lowered by the arm drives so that successive segments placed on the arms by the stacker form a partial stack 40 of web segments, the top of which is maintained a fixed distance below the infeed conveyor for properly receiving segments 38 from the stacker. When the appropriate number of segments has been placed on the arms to form a full stack 42, the arms are rapidly lowered and then separated to place the stack on the discharge conveyor 20. At the same time, and before the stacker pushes the next web segment below the infeed conveyor, the other pair of arms is moved in above the completed stack at the proper level below the infeed conveyor to receive successive segments and form the next stack in the manner previously described.

Figures 2, 7:
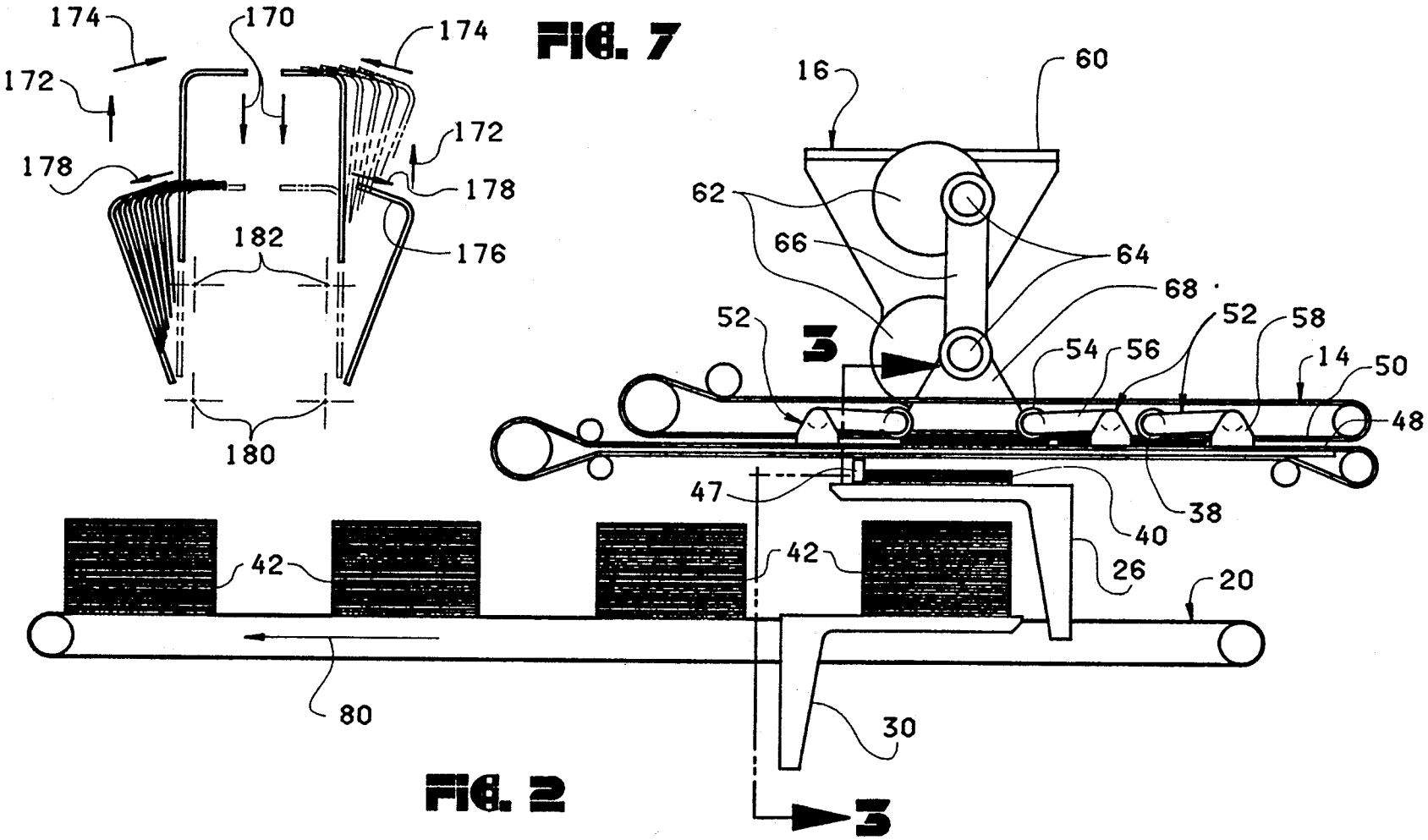
FIG. 2 is an enlarged view of the upper portion of FIG. 1.
FIG. 7 illustrates the path of movement of the stack support arms.
Figure 3:
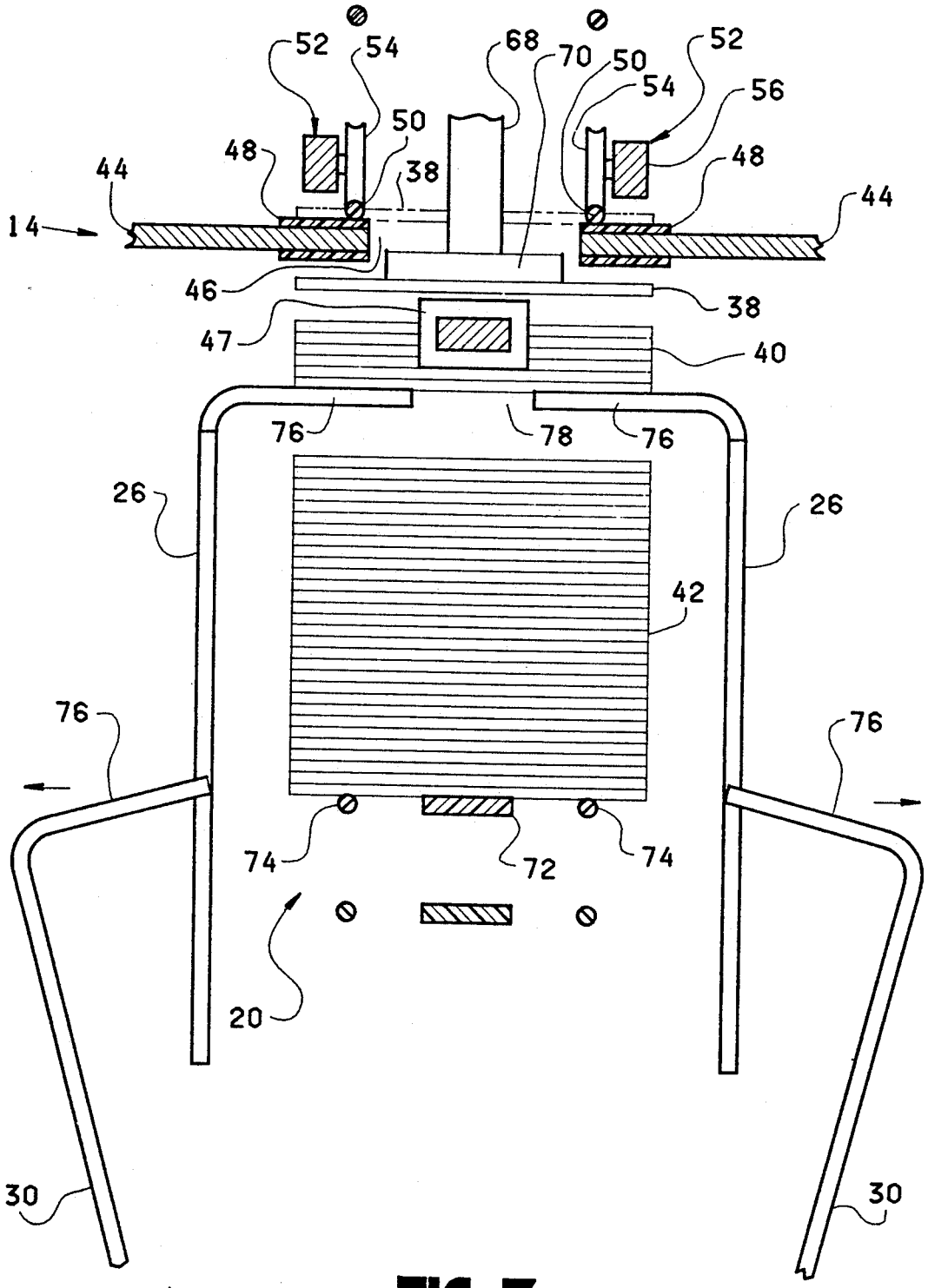
FIG. 3 is a sectional view taken generally along line 3—3 of FIG. 2.

The sheet infeed conveyor 14 shown in FIGS. 2 and 3 includes a pair of support plates 44 which extend from the upstream end of the conveyor adjacent the cutter 36 past the stacker 16. The plates are separated by gap 46. A pair of flat feed belts 48 include upper runs extending along the inner edges of the plates 44 adjacent the gap. The upper runs move downstream in the direction of arrow 34. The return runs of belts 48 are located under the plates as shown in FIG. 3. Cylindrical hold down belts 50 include downstream moving runs located immediately above belts 48 at the edges of the plates. The return runs of belts 50 are located above the downstream runs. As shown in FIG. 2, belts 48 and 50 are trained around return rolls at the upstream and downstream ends of conveyor 14. If desired, additional flat feed belts (not illustrated) may be located in the gap 46 upstream of stacker 16 to support the center of a web segments 38 moved from the cutter 36 to the stacker 16.

A plurality of gravity hold downs 52 are mounted on plates 44 to engage the tops of belts 50 and improve frictional engagement between both belts and the edges of the segments, which may be wet and slippery. Each hold down 52 includes a roller 54 mounted on the end of a pivot arm 56 which is in turn mounted on a base 58 secured to the plate. Rollers rest on belts 50. The weight of the arms and rollers holds the belts against edges of the segment to facilitate feeding. FIG. 2 illustrates a pair of hold downs 52 mounted on each plate 44 to either side of the stacker 16. The belts 48 and 50 are moved continuously downstream during operation of machine 10 by conventional drives.

Sheet stacker or pusher 16 includes a frame element 60 mounted on frame 12 above the infeed conveyor 14, a pair of vertically spaced rotary members 62 journalled in the element, a crank 64 extending outwardly from each element, a vertical link 66 joining the cranks, a foot 68 on the bottom of the link movable vertically and along the direction of movement of web segments 38 on the infeed conveyor as shown in FIGS. *6a–6d*. The push plate 70 mounted on the bottom of foot 68 is as long or longer than the web segments 38. As shown in FIG. 3, the width of plate 70 is slightly less than the width of gap 46 to permit moving segments down from the infeed conveyor to the partial stack 40. Members 62 are continuously rotated during operation of machine 10 so that the push plate 70 is repetitively extended and retracted as shown in FIGS. *6a–6d* to move each web segment 38 from the infeed conveyor to the partial stack.

The stack discharge conveyor 20 includes a continuously downstream moving flat stack feed belt 72 and a pair of downstream moving cylindrical support belts 74 located to either side of belt 72. The belts 72 and 74 are wrapped around conventional return rollers and include lower runs shown in FIG. 3. Stacks supported on the two arms 26, 30 are lowered onto the belts 72 and 74 as illustrated in FIG. 3. When a pair of arms, either 26 or 30, is in the stack receiving position shown by arms 26 in FIG. 3 web segments 38 are placed on a pair of coplanar stack supports or members 76 spaced apart by a gap 78 slightly wider than the width of belt 72. Lowering of the arms to place the stack 42 on the discharge conveyor moves the stacks supports 76 downwardly and beyond the belt 72 to lower the stack onto the belt for subsequent downstream movement in the direction of arrow 80 shown in FIG. 2. The downward movement of the supports 76 deflects the belts 74 downwardly. After the stack has been placed on belt 72, the arms are rapidly rotated horizontally outwardly of the discharge conveyor as indicated in FIG. 3 thereby allowing belts 74 to return to their normal support positions to either side of belt 72 and support the downstream moving stack 42. The stack supports 76 on each pair of arms 26, 30 are repetitively moved through the positions shown in FIG. 7 by the respective arm drive 28, 32.

Figure 4:
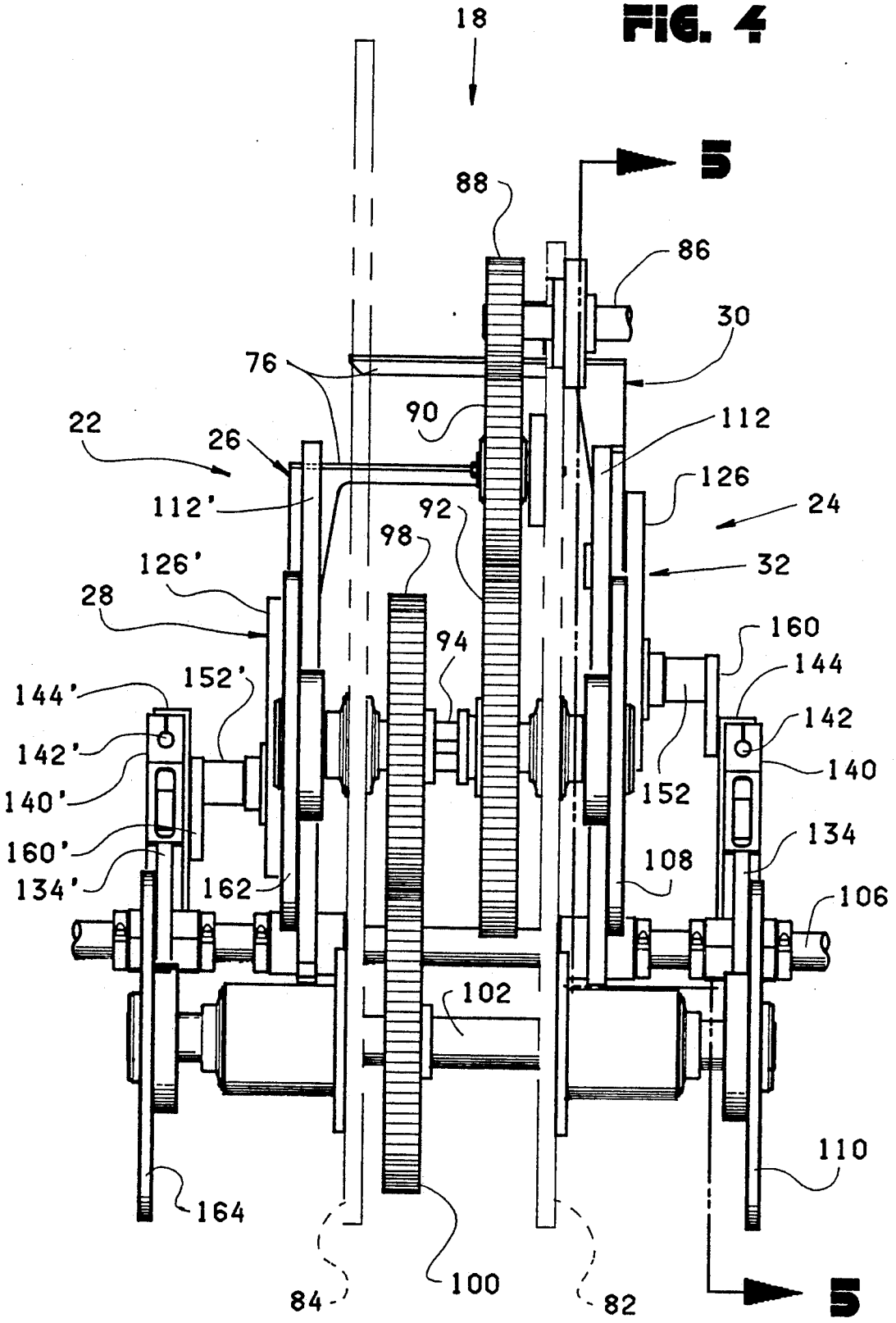
FIG. 4 is an enlarged view of the opposite side the machine, partially broken away, illustrating the drive for the stack support assembly.

The arm drives 28 and 32 repetitively move the support arms 26 and 30 through the positions of FIG. 7 with the exception that the two drives are 180 degrees out of phases with each other so that the stack supports 76 of each of the pairs of arms 26 and 30 are moved around the cycle of operation in 180 phase relation with each other. FIG. 4 illustrates both arm drives 28 and 32. FIGS. *5a–5c* illustrate details of arm drive 32. Arm drive 28 is similar to arm drive 32.

Machine 10 includes a pair of vertical support plates 82 and 84 shown in phantom in FIG. 4 for purposes of clarity. A power input shaft 86 is rotatably mounted on the top of plate 82 and carries an input gear 88 meshed with an idler gear 90 also mounted on plate 82. Gear 90 engages drive gear 92 on upper support shaft 94 likewise journalled in bearings carried by plates 82 and 84. The shaft 94 is rotated continuously in the direction of arrow 96 shown in FIG. *5a*. The shaft carries a second drive gear 98 which engages drive gear 100 on lower shaft 102 also journalled in bearings carried by plates 82 and 84. The gears 98 and 100 are the same diameter and pitch so that shafts 94 and 102 rotate at the same speed with shaft 102 rotating in the direction of arrow 104 shown in FIG. *5a*. Arm drives 28 and 32 are driven by rotation of shafts 94 and 102. A fixed support shaft 106 is mounted on plates 82 and 84 and on the frame 12 to either side of the plates. Two pairs of elongate support plates 76 extend in a downstream direction along both the infeed and discharge conveyors 14 and 20. The plates have upstream and downstream ends with the upstream ends of one pair of plates connected to drive 28 and the downstream ends of the other pair of plates connected to drive 32. Drive 28 is located upstream from both pairs of plates and drive 32 is located downstream from both pairs of plates.

Arm drive 32 includes a vertical movement rotary cam 108 mounted on shaft 94 and a horizontal movement rotary cam 110 mounted on shaft 102. The lower end of generally vertically extending pivot arm 112 is rotatably mounted on shaft 106. The arm carries a rotary cam follower 114 which engages the circumferential face of cam 108. Spring 116 extends between the upper end of arm 112 and frame 12 and holds the follower 114 against the cam 108. One end of link 118 is rotatably mounted to pivot arm 112 above follower 114 and the other end of the link is pivotedly mounted to one arm of a crank 120 which is rotatably mounted on a shaft 122 carried by frame 12. Short link 124 pivotedly connects another arm of the crank 120 to arm support plate 126. Vertical shaft 128 and vertical square guide post 130 are mounted on frame 12 located adjacent to plate 126. The plate is connected to the shaft and post for vertical movement by suitable bushings 127 surrounding shaft 128 and guide rollers 129 engaging opposed sides of post 130. As shown in FIG. *5a*, the plate 126 extends to the left beyond shaft 128 and below the discharge conveyor 20.

Arms 30 are pivotedly mounted to the portion of plate 126 beneath the discharge conveyor on pivot pins 132. Rotation of cam 108 rotates arm 112 and crank 120 to raise and lower the arms vertically independent of the rotational position of the arms on the pins 132.

Pivot arm 134 is rotatably mounted on shaft 106 and carries a rotary cam follower 136 on its lower end engagable with the circumferential cam surface of rotary cam 110. One end of link 138 is pivotedly connected to the upper end of pivot arm 134 and the other end of the link is pivotedly connected to a vertical bar 140. The bar is connected to slide rods 142 extending through fixed slide block 144 mounted on the frame 12. Rods 142 extend out from the block and are connected on their other ends to a vertical U-shaped track 146 defining a vertical slot 148 facing the support plate. Spring 150 is connected between post 130 and the upper end of arm 134 to maintain follower 136 in engagement with the surface of rotary cam 110.

A rotatable shaft 152 extends through the portion of plate 126 between the vertical shaft 128 and post 130. Double ended pivot arm 154 is mounted on shaft 152 on the arm side of plate 126 as shown in FIG. *5a*. Pivot connections on the ends of links 156 and 158 join the upper end of arm 154 to the lower end of adjacent stack support arm 30 and the lower end of arm 154 to the lower end of the remote stack support arm 30. As shown in FIG. *5a*, the distance between the pivot pins 132 and the pivot connections with the links 156 and 158 at the lower ends of the arms 30 is considerably less than the distance between the pivot pins and the stack supports 76 thereby facilitating rapid horizontal movement of the stack supports in response to rotation of shaft 152.

Crank arm 160 shown in FIG. 4 is mounted on the end of shaft 152 extending through support plate 126. A rotary follower (not illustrated) mounted on the end of arm 160 away from shaft 152 is fitted within the slot 148 in vertical track 146. Rotation of cam 110 rotates pivot arm 134 to move the vertical track 146 back and forth horizontally and thereby rotate shaft 152 and pivot the arms 30 and supports 76 horizontally independent of the vertical position of the support plate.

The arm drive 28 of stack support unit 22 includes components identical to the components of arm drive 32 with the exception that the vertical movement rotary cam 162 and horizontal movement rotary cam 164 of arm drive 28 are oriented 180 degrees out of phase with cams 108 and 110 so that arms 28 move through the same path as arms 30 but 180 degrees out of phase with arms 30. With this exception, the two arm drives are symmetrical to either side of a central vertical plane extending through the machine 10 perpendicularly to the plane of FIG. 4. Elements of arm drive 28 shown in FIG. 4 are identified using the same reference numbers used to describe the elements in drive 32 with the addition of a prime symbol (').

The operation of stacking machine 10 will now be described.

A web is continuously fed toward two roll web cutter 36 in the direction of arrow 44 and is severed by the cutter into web segments 38. The segments are fed downstream along the sheet infeed conveyor 14 with the lateral edges of the segments confined between feed belts 48 on plates 44 and hold down belts 50 located above the feed belts. Belts 48 and 50 move downstream at the same speed to feed the segments to sheet stacker 16. Gravity hold downs 52 rest on the belts 50 to increase the friction between the belts 50 and 48 and the edges of the segments to assure proper feeding of the segments. This is important when segments 38 are formed of a slippery material or are saturated with liquid and are difficult to feed.

The continuously rotating members 62 of stacker 16 lower the push plate 70 into engagement with the top of each segment 38 as the segment is moved under the stacker. Lowering of the plate strips the segment away from between conveyor belts 48 and 50 and moves the segment through recess or gap 46 between plates 44 and down below the plates. When plate 70 engages the segment 38 the plate has a forward or downstream component of movement equal to the downstream speed of the segment to assure non-slip engagement with the segment and, with further rotation, downward movement of the segment through the gap. When plate 70 moves to the bottom of its stroke, a distance above supports 76 or the top of the partial stack 40, the segment falls away from the plate and onto the supports 76 or partial stack 40 with the lead end of the segment engaging stop 47, thereby assuring that the stack is uniformly formed. The segment has a downstream component of movement when it falls free from the plate. Continued rotation of members 62 raises the push plate above the infeed conveyor 14 to permit downstream movement of the next segment 38 for placement on the partial stack the next time the plate is lowered.

Stacking of wet segments 38 is facilitated because the segments are heavier than dry segments and fall rapidly from the plate onto the partial stack. Additionally, wet segments adhere to each other when stacked to maintain the proper shape of the partial stack during stacking and the proper shape of the stack during movement on discharge conveyor 20.

Figure 5A:
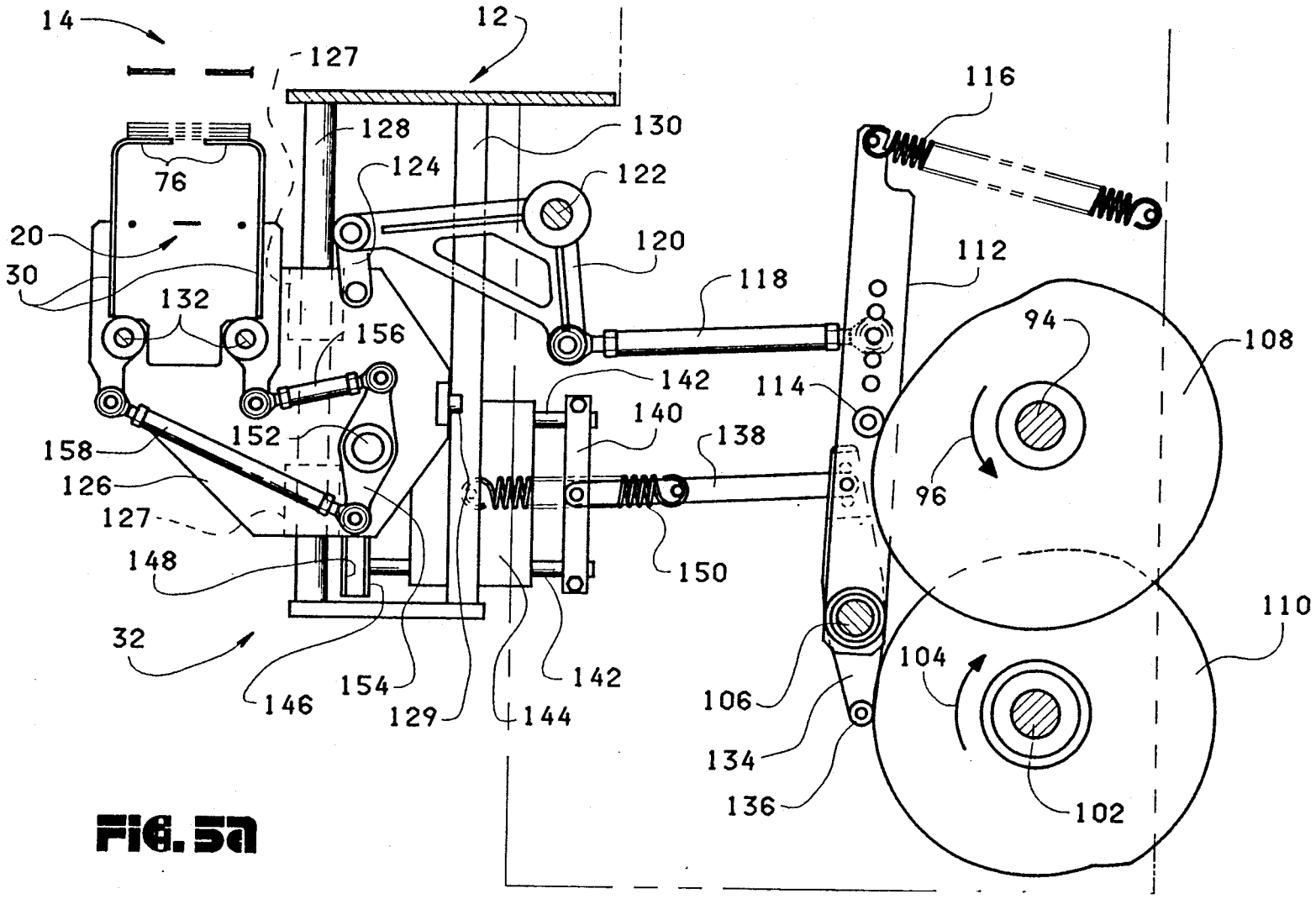
FIGS. 5*a*, 5*b* and 5*c* are sectional views taken generally along line 5—5 of FIG. 4 illustrating the operation one arm drive of the stack support assembly.
Figure 5B:
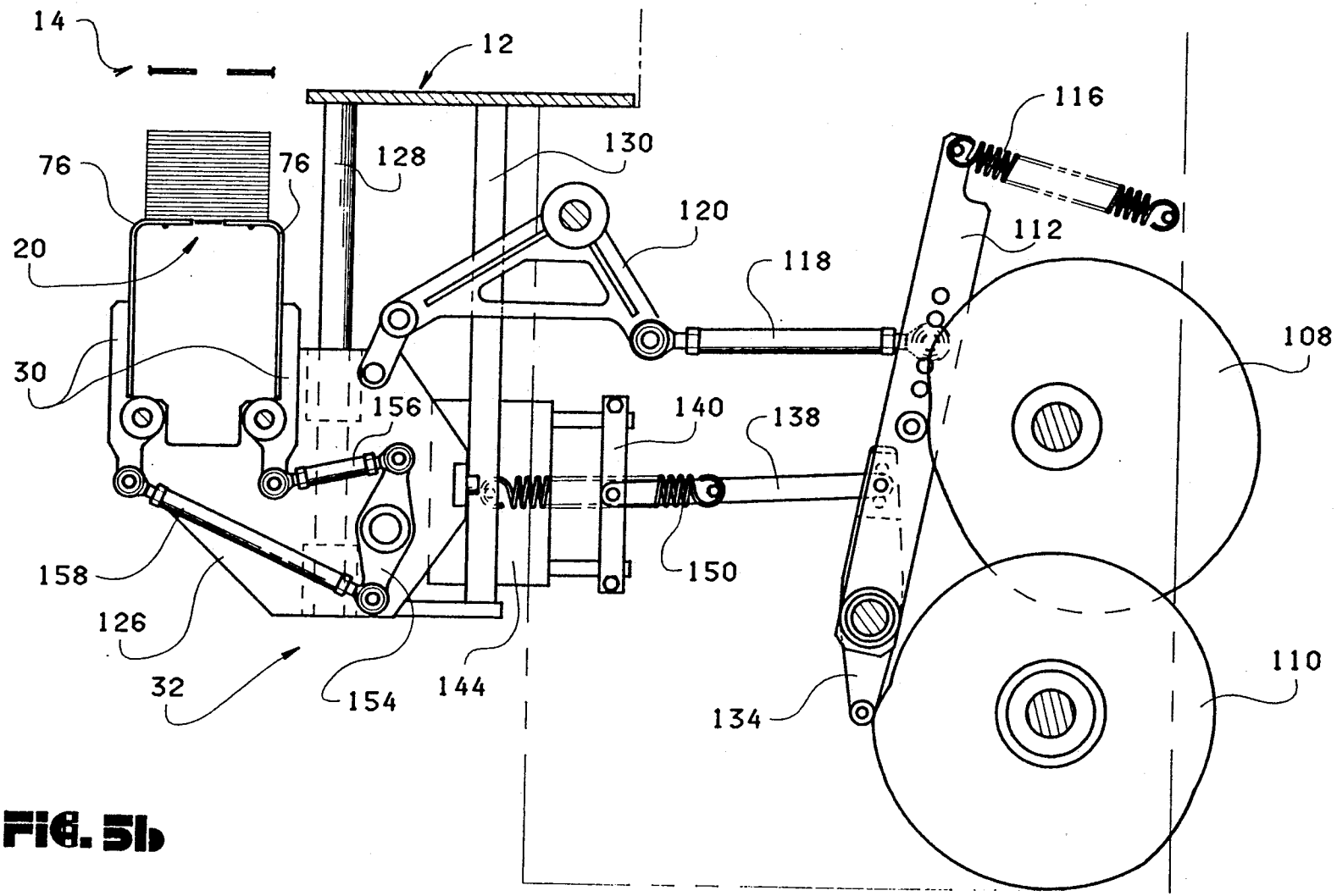
Figure 5C:
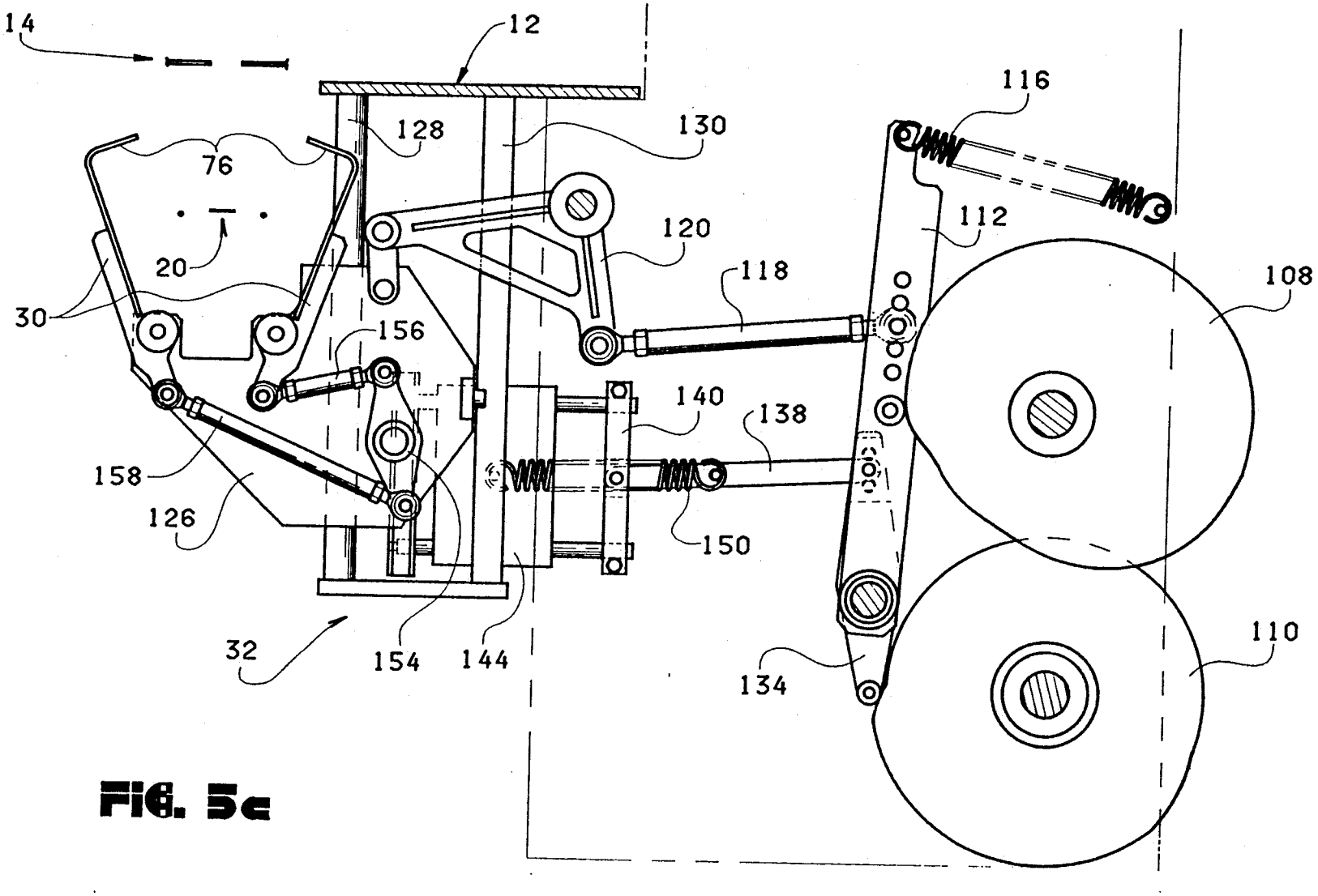
Figure 6A:
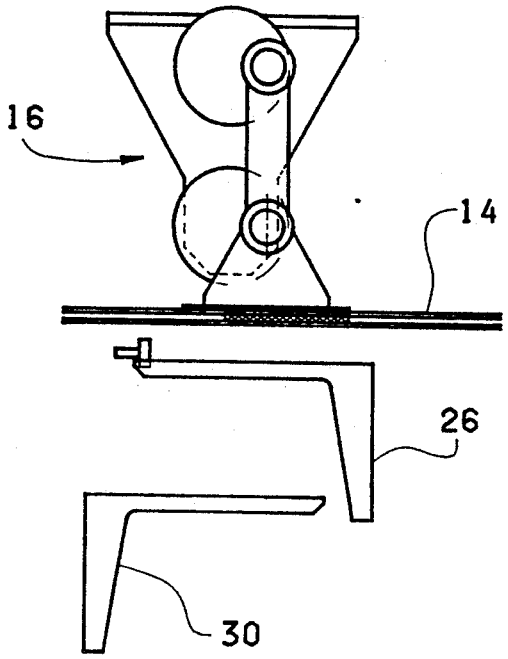
FIGS. 6*a*, 6*b*, 6*c* and 6*d* illustrate a cycle of operation of the sheet stacker.
Figure 6B:
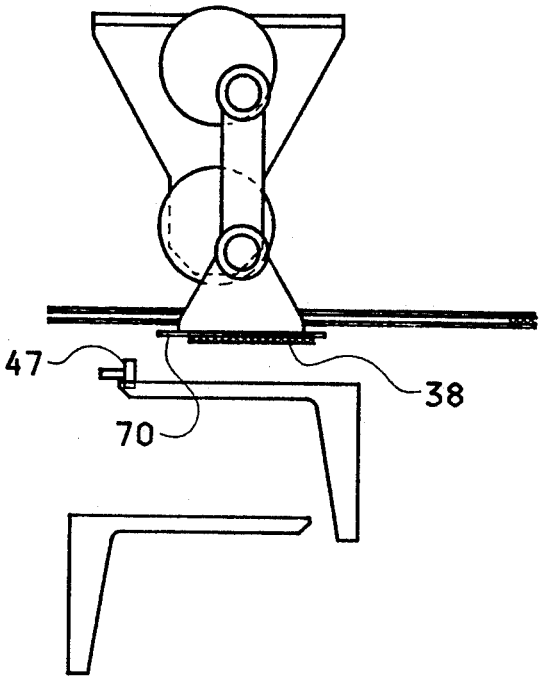
Figure 6C:
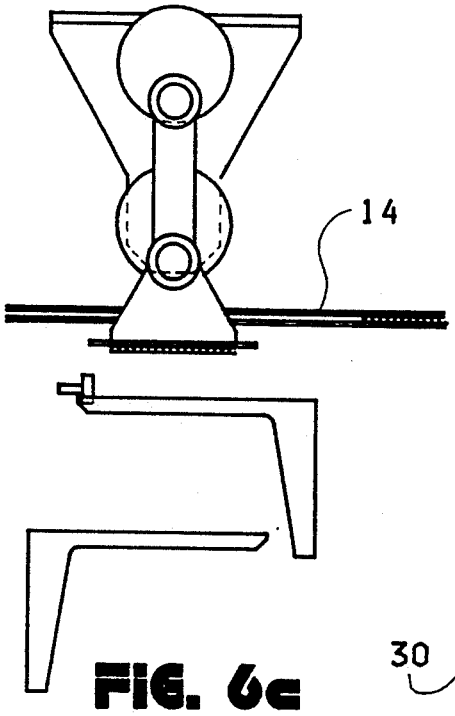
Figure 6D:
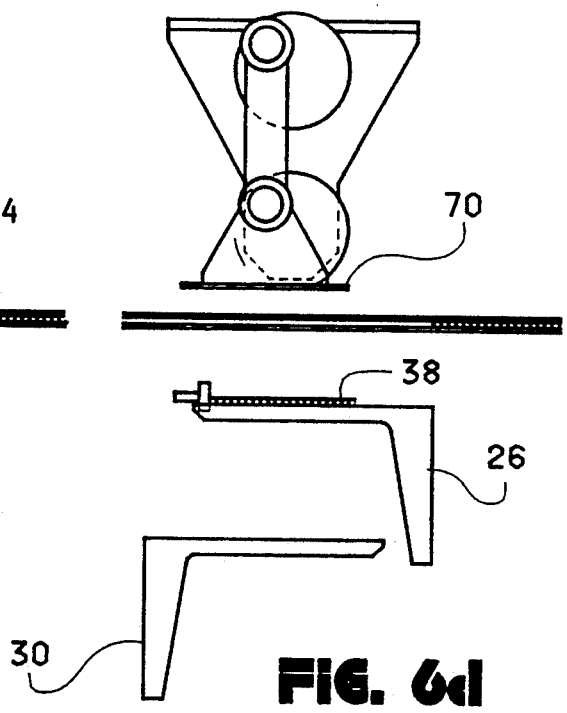

During addition of segments 38 to the partial stack rotation of the appropriate vertical movement rotary cam 108 or 162 of the arm drive for the arms supporting the partial stack moves a fall surface past the roller on arm 112 or 112' thereby pivoting the upper end of the arm to the right as shown in FIG. 5*a* and lowering the arm support plate and the pair of arms supporting the partial stack. In FIG. 3, arms 26 are shown supporting the stack. Rotation of cam 162 causes the plate 126' and arms 26 to lower at the rate segments 38 are added to the stack thereby assuring the upper surface of the stack is maintained at a proper level for receiving additional segments.

As segments are placed on one pair of arms 26, 30 and the arms are moving down in the direction of arrows 170 shown in FIG. 7, the cam follower on the pivot arm 134 or 134' of the arm drive for the arms moves along a dwell surface of horizontal movement cam 110 or 164 so that the arms are held in the position of arms 26 shown in FIG. 3.

During lowering of the arms supporting the partial stack the arms which are not supporting the partial stack are in the open or horizontally-spread position with supports 76 of such arms outwardly of the arms supporting the partial stack. The vertical movement rotary cams 108, 162 for such arms moves the open arms upwardly in the direction of arrows 172 shown in FIG. 7 so that the stack supports 76 are moved up past the stack support surfaces 76 of the arms supporting the stack.

As soon as the requisite number of segments 38 has been added to the partial stack to complete the stack a steep fall surface on the appropriate vertical movement cam moves past follower on cam arm 112 or 112' to lower the support arms and completed stack and rapidly place the stack on the take away conveyor belt 72. The top of the stack is lowered below stop 47. At this time, the non-support arms have been raised fully vertically in the direction of arrow 172. Rotation of the horizontal movement rotary cam for the non-support arms moves a sharp rise surface past the follower on arm 134 or 134' so that rotation of the arm 134 rotates pivot arm 154 in a clockwise direction as viewed in FIG. 5*a* to rotate very rapidly the upper ends of the non-support arms and stack supports 76 inwardly to the support position where the supports 76 are located the proper distance beneath the infeed conveyor to receive segments 38. Inward rotation of the non-support arms occurs during the interval before the continuously rotating members 62 move plate 70 down to place the next web segment 38 onto the newly positioned supports 76. The stack supports 76 are rotated inwardly in a direction of arrows 174 shown in FIG. 7. The supports are moved down as the partial stack grows, as previously described. In this way, stacks are alternately accumulated on support arms 26 and 30 and transferred to the discharge conveyor.

As soon as the stack supports 76 deposit the completed stack 42 on the takeaway conveyor belt 72, the vertical rotary cam for such supports is dwelled for an interval and the horizontal movement rotary cam very rapidly moves the supports outwardly of the stack to the position 176 shown in FIG. 7. Such movement is generally in the direction of arrows 178. After full outward horizontal movement away from the stack supports 76, the arms and stacks supports are moved vertically upwardly in the direction of arrows 172 to be in position for rapid inward movement upon completion of the next stack.

As indicated in FIG. 1, the support arms 26 and 30 move up and down in an open area located between the infeed conveyor 14 and discharge conveyor 20 and between the two cam drives 28 and 32. The open area permits ready visual inspection of the stacking operation and facilitates manual adjustment of the machine. Further, the machine provides ample space for locating drip-catching troughs and piping under the conveyors (not illustrated) to carry away liquid falling from the saturated web segments and stacks during movement through the machine.

The machine is readily adjustable to accommodate different cut length and width segments and stack heights. The width of the conveyors 14 and 20 may be easily adjusted using conventional means. The distance between the conveyors is also adjustable. The cycle of arms 26 and 30 shown in FIG. 7 is readily adjustable by mounting different profile horizontal and vertical movement cams 108, 110, 162 and 164 on the ends of shafts 94 and 102. As illustrated in FIG. 4, the cams are mounted on free ends of the shafts and can be easily replaced by different profile cams as required.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What is claimed is:

1. Apparatus for receiving individual web segments and placing the segments in stacks, the apparatus comprising a) an infeed conveyor having a first pair of spaced apart and parallel first infeed conveyor belts for feeding a succession of web segments downstream to an orbital pusher;

b) an orbital pusher located adjacent to the infeed conveyor between first and second drive means and repetitively movable from above the infeed conveyor down between and below the first infeed conveyor belts to push successive segments fed along the infeed conveyor down between the infeed conveyor belts and below the infeed conveyor so that the segments fall onto a pair of stack support members to form a stack of web segments;

c) a discharge conveyor located below the orbital pusher and extending in the same direction as the infeed conveyor for receiving stacks of web segments from a pair of stack support members and moving the stacks away from the stack support members, the discharge conveyor including a central discharge conveyor belt located below the infeed conveyor belts;

d) two like pairs of stack support members, each pair of stack support members including a first member located on one side of the infeed conveyor and extending a distance along the infeed conveyor and a second member located on the opposite side of the infeed conveyor across from the first member and extending a distance along the infeed conveyor, each said first and second stack support member having an upstream end and a downstream end relative to the infeed conveyor;

e) first drive means joined to the upstream ends of a first pair of stack support members for simultaneously and repetitively moving the first pair of stack support members around two like stacking paths located on opposite sides of the conveyors, the paths each starting at a first position located below an infeed conveyor belt and the orbital pusher, extending down and away from the infeed conveyor belt to one side of the discharge conveyor belt, outwardly away from the discharge conveyor belt and then back up to the first position, the first pair of stack support members being spaced apart when moved down to place stacks of web segments supported on the first pair of members on the central discharge conveyor belt;

f) second drive means joined to the downstream ends of a second pair of stack support members for simultaneously and repetitively moving the second pair of stack support members around the paths 180 degrees out of phase with said first pair of stack support members to place stacks of web segments supported on the second pair of stack support members on the central discharge conveyor belt; and g) said first drive means being located upstream of both pairs of stack support members relative to the infeed conveyor and said second drive means being located downstream of both pairs of stack support members relative to the infeed conveyor whereby a stacking area below the pusher and between the conveyors is unobstructed by said drive means.

2. Apparatus as in claim 1 wherein the discharge conveyor includes a pair of outer belts located to either side of and extending parallel to the central belt, said outer belts being downwardly deformable by stack support members and extending across said paths, whereby said drive means move said stack support members down from said first positions and into deforming engagement with said outer belts during placement of stacks on the central discharge conveyor belt.

3. Apparatus as in claim 1 wherein the infeed conveyor includes a second pair of spaced apart and parallel second infeed conveyor belts located on top of said first infeed conveyor belts and movable with said first conveyor belts for feeding webbed segments confined between such belts to the orbital pusher.

4. Apparatus as in claim 3 including means for biasing the first and second infeed conveyor belts together.

5. Apparatus as in claim 1 including stop means located between the first infeed conveyor belts and a distance below the infeed conveyor for locating the position of web segments placed by the orbital pusher on stack support members or on a partial stack.

6. Apparatus as in claim 5 wherein said stop means is located downstream of the orbital pusher.

7. Apparatus as in claim 1 wherein each drive means includes horizontal drive means for moving the support members toward and laterally away from the conveyors and vertical drive means for moving said support members down from said first positions and up to said first positions.

8. Apparatus as in claim 7 including a frame, first and second rotary shafts mounted on the frame and wherein each horizontal drive means includes a horizontal rotary cam mounted on the first shaft, a first follower engaging such rotary cam and an operative connection joining such follower and a pair of stack support members; each vertical drive means including a vertical rotary cam mounted on the second shaft, a second follower engagable with such rotary cam and a second operative connection joining said second follower to a pair of stack support members.

9. Apparatus as in claim 8 wherein said rotary cams are removably mounted on free ends of said shafts.

10. Apparatus as in claim 9 wherein said operative connections comprise elongate arms pivotally connected to the frame.

11. Apparatus for receiving a plurality of web segments and placing the segments in a plurality of stacks, the apparatus comprising, a) an infeed conveyor for feeding a succession of web segments in a downstream direction to a web segment pusher;

b) a web segment pusher located above the infeed conveyor and movable to push successive lead segments fed along the infeed conveyor below the infeed conveyor and onto a pair of stack support members;

c) a discharge conveyor located below the infeed conveyor for receiving stacks of web segments from a pair of stack support members and moving the stacks away from stack support members;

d) two pairs of elongate and opposed stack support members, each pair of stack support members extending a distance along opposite sides of the discharge conveyor below the web segment pusher, each stack support member having an upstream end and a downstream end relative to the discharge conveyor;

e) first drive means for repetitively moving each member of a first pair of stack support members around a continuous stacking path starting at a first position located below the infeed conveyor and the pusher, extending down to one side of the discharge conveyor, laterally away from the discharge conveyor and then back to the first position and placing stacks on the first pair of support members on the discharge conveyor, said first drive means being located upstream of both pairs of stack support members relative to the discharge conveyor and connected to the upstream ends of the first pair of stack support members; and f) second drive means for repetitively moving each member of the second pair of support members on the discharge conveyor, said second drive means being located downstream of both pairs of stack support members relative to the discharge conveyor and connected to the downstream ends of the second pair of stack support members;

g) whereby said drive means do not obstruct a stacking area located beneath the pusher and between the infeed and discharge conveyors.

12. Apparatus as in claim 11 wherein the infeed conveyor comprises a first pair of spaced apart and parallel infeed conveyor belts, and a second pair of spaced apart and parallel infeed conveyor belts located above said first belts; and the discharge conveyor includes a central belt and a pair of parallel outer belts located to either side of the central belt, said outer belts being downwardly deformable by said stack support members.

13. Apparatus as in claim 12 wherein each drive means includes horizontal drive means for moving the support members toward and laterally away the conveyors and vertical drive means for moving said support members down from said first positions and up to said first positions.

14. Apparatus as in claim 13 including frame, first and second rotary shafts mounted on the frame and wherein each horizontal drive means includes a horizontal rotary cam mounted on the first shaft, a first follower engaging such rotary cam and an operative connection joining such follower and a pair of stack support members each vertical drive means including a vertical rotary cam mounted on the second shaft, a second follower engagable with such rotary cam and a second operative connection joining said second follower to a pair of stack support members.

15. Apparatus as in claim 14 wherein said rotary cams are removably mounted on free ends of said shafts.

16. Apparatus as in claim 15 wherein said operative connections comprise elongate arms pivotally connected to the frame.

* * * * *

UNITED STATES PATENT AND TRADEMARK OFFICE

CERTIFICATE OF CORRECTION

PATENT NO. : 5,328,323

DATED : July 12, 1994

INVENTOR(S) : Robert E. Molison

It is certified that error appears in the above-identified patent and that said Letters Patent is hereby corrected as shown below:

Column 10, line 4, (Claim 11, line 37), before "support members", insert --stack--.

Column 10, line 4, (Claim 11, line 37), after "support members", insert --around the stacking paths out of phase with the first pair of stack support members and between said first pair of stack support members and placing stacks on the second pair of support members--.

UNITED STATES PATENT AND TRADEMARK OFFICE

CERTIFICATE OF CORRECTION

PATENT NO. : 5,328,323

DATED : July 12, 1994

INVENTOR(S) : Robert E. Molison

It is certified that error appears in the above-indentified patent and that said Letters Patent is hereby corrected as shown below:

Column 10, line 10, claim 11, line 43, delete "g)".

Signed and Sealed this

First Day of November, 1994

Bruce Lehman

*Attest:*

BRUCE LEHMAN

*Attesting Officer*

*Commissioner of Patents and Trademarks*